US011156329B2

(12) United States Patent
Mitsuzuka et al.

(10) Patent No.: US 11,156,329 B2
(45) Date of Patent: Oct. 26, 2021

(54) LIGHT-EMITTING DIODE-TYPE ILLUMINATION DEVICE

(71) Applicant: ABRAM Corporation, Tokyo (JP)

(72) Inventors: Hidetoshi Mitsuzuka, Tokyo (JP); Yujiro Kojima, Tokyo (JP); Kenichi Kurihara, Tokyo (JP); Kazunori Kojima, Tokyo (JP)

(73) Assignee: ABRAM CORPORATION, Tokyo (JP)

( * ) Notice: Subject to any disclaimer, the term of this patent is extended or adjusted under 35 U.S.C. 154(b) by 0 days.

(21) Appl. No.: 16/337,049

(22) PCT Filed: Sep. 26, 2017

(86) PCT No.: PCT/JP2017/036897
§ 371 (c)(1),
(2) Date: Dec. 20, 2019

(87) PCT Pub. No.: WO2018/062575
PCT Pub. Date: Apr. 5, 2018

(65) Prior Publication Data

US 2020/0217462 A1 Jul. 9, 2020

(30) Foreign Application Priority Data

Sep. 29, 2016 (JP) ..... JP2016-203909

(51) Int. Cl.
*F21K 9/68* (2016.01)
*F21V 29/70* (2015.01)
*F21K 9/275* (2016.01)
*F21V 7/00* (2006.01)
*F21Y 103/10* (2016.01)
*F21Y 115/10* (2016.01)

(52) U.S. Cl.
CPC ..... *F21K 9/68* (2016.08); *F21K 9/275* (2016.08); *F21V 7/005* (2013.01); *F21V 29/70* (2015.01); *F21Y 2103/10* (2016.08); *F21Y 2115/10* (2016.08)

(58) Field of Classification Search
None
See application file for complete search history.

(56) References Cited

U.S. PATENT DOCUMENTS

2011/0194282 A1* 8/2011 Paik ..... F21V 7/0083 362/245
2011/0317428 A1* 12/2011 Paik ..... F21V 19/0055 362/294
2017/0254485 A1* 9/2017 Mitsuzuka ..... F21V 7/005

* cited by examiner

*Primary Examiner* — Elmito Breval
(74) *Attorney, Agent, or Firm* — Westerman, Hattori, Daniels & Adrian, LLP

(57) ABSTRACT

Provided is a light-emitting diode-type illumination device with which it is possible to irradiate a broad area with light irradiated from an LED light source. The light-emitting diode-type illumination device comprises an illuminance stimulating means for confining light irradiated from the LED light source in a light-confining means, and stimulating the illuminance of the confined light before irradiating said light.

6 Claims, 8 Drawing Sheets

③ Light distribution of LED element

FIG. 7(b)

④ Light distribution of commercially-available linear tube LED

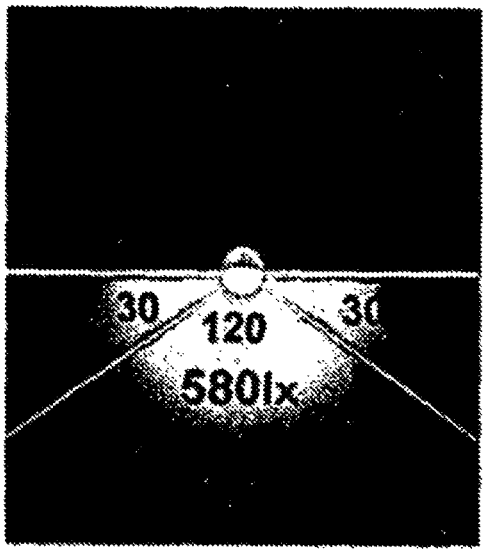

The commercially-available LED is designed to have 120-degree light distribution and does not effectively use each 30-degree area of the left and right sides (total 90-degree). Since the LED does not have a reflection member, it shows the same distribution in vertical irradiation.

The commercially-available linear tube LED has smaller illumination intensity as compared with a fluorescent lamp with a reflection plate.

⑤ Irradiation of light from Abraham LED (clear 120 deg., milk-white 180 deg.) · illumination intensity · PPFD Illumination intensity Lx: 1680 (5000K clear) ~ 750 (3000K milk-while)

PPFD: 175 (5000K clear) 150 (3000K milk-while) mol, 20cm vertical direction

Entire light beam: 2680lm

LIGHT-EMITTING DIODE-TYPE ILLUMINATION DEVICE

TECHNICAL FIELD

The present invention relates to a light emitting diode lighting device, and more particularly to a straight tube light emitting diode lighting device.

BACKGROUND AT

An LED can reduce power consumption and can provide the same level of illuminance and light energy as conventional incandescent and fluorescent lamps, as compared to conventional lighting devices. For this reason, LEDs are expected to further spread in the future. The straight tube light emitting diode type illumination device has an appearance similar to that of a fluorescent lamp that can be used as a substitute light source for a fluorescent lamp, and thus can be attached to an existing fluorescent lamp fixture. For example, Patent Literatures 1 and 2 describe straight tube type LED lighting tubes.

The conventional straight tube LED lighting tube cannot irradiate the light emitted from the LED light source in a wide range at a predetermined illuminance.

PRIOR ART DOCUMENT

Patent Document

1. Patent publication number 2014-053267
2. Patent publication number 2013-219004

SUMMARY OF THE INVENTION

The object of the invention can emit light emitted from an LED light source widely.

Means for Solving the Problem

The light emitting diode type illumination device according to the present invention comprises an LED illumination tube provided with a total luminous flux transmission plate disposed in the light irradiation direction, and an LED element provided on the substrate opposite the total transmission plate in the LED illumination tube. And a light reflecting member provided with a light collecting and reflecting surface disposed on the light emitting side of the LED element. The light reflecting member is disposed to extend in the light irradiation direction symmetrically or asymmetrically with respect to the center line of the LED element, and has light intensity control means for controlling the light distribution intensity irradiated with light emitted from the LED element being distributed.

The lighting apparatus has a light collecting reflection surface, and the light collecting reflection surface gives light directivity to the light emitted from the LED element by the light reflection member and allows the light from the LED illumination tube to be irradiated outside the tube through the total luminous flux transmitting plate. A light directing formation surface and a pseudo LED element formation surface for projecting a pseudo LED element of an LED element are provided.

The reflecting member is connected to the first reflecting member and the first reflecting member, which are disposed extending in the light irradiation direction symmetrically or asymmetrically with respect to the center line of the LED element with respect to the installation surface of the light source. A second reflection member is provided along the shape of the light beam transmission plate.

The means comprises a material for activating the reflected light from the light reflecting member provided on the total luminous flux transmitting plate, and/or the illuminance activation means comprises a light reflecting material provided on the inner surface of the reflecting member facing the total light beam transmitting plate, and/or a light reflecting material provided on the inner surface of the recess provided in the reflecting member facing the total light beam transmitting plate and/or a light reflecting material provided on the inner surface of the space between the total luminous flux transmitting plate and the light reflecting member.

The illuminance activation means comprises at least one of a light reflecting sheet, a light reflecting film, a light diffusing film, a light diffusing sheet, a mirror, and gold or silver plating on the light reflecting surface facing the all light flux transmitting plate. In addition, the light reflecting member has light transmission characteristics and/or light reflection characteristics.

Effect of the Invention

The present invention provides a light emitting diode type illumination device capable of emitting a wide range of light emitted from an LED light source.

BRIEF DESCRIPTION OF THE DRAWINGS

FIG. 7(*b*) is schematic which shows irradiation of the light from the LED element of a commercially available straight tube pipe type illuminating device.

FIG. 7(*c*) is a schematic view showing the illumination of light from the LED of the straight tube type lighting device of the present invention.

EMBODIMENTS TO CARRY OUT THE INVENTION

The light emitting diode type illumination device according to the present invention comprises an LED illumination tube having a total luminous flux transmission plate disposed in a light irradiation direction, and a light source disposed on a substrate facing the total luminous flux transmission plate in the LED illumination tube and a light reflecting member provided with a light reflecting surface having a light reflecting property disposed on the light emitting side of the LED element, and light confined from the LED light source in the light confinement means and illumination intensity activating means for activating and illuminating the illumination intensity. The light reflecting member is disposed to extend in the light emission direction symmetrically or asymmetrically with respect to the center line of the LED element.

Figure 4:
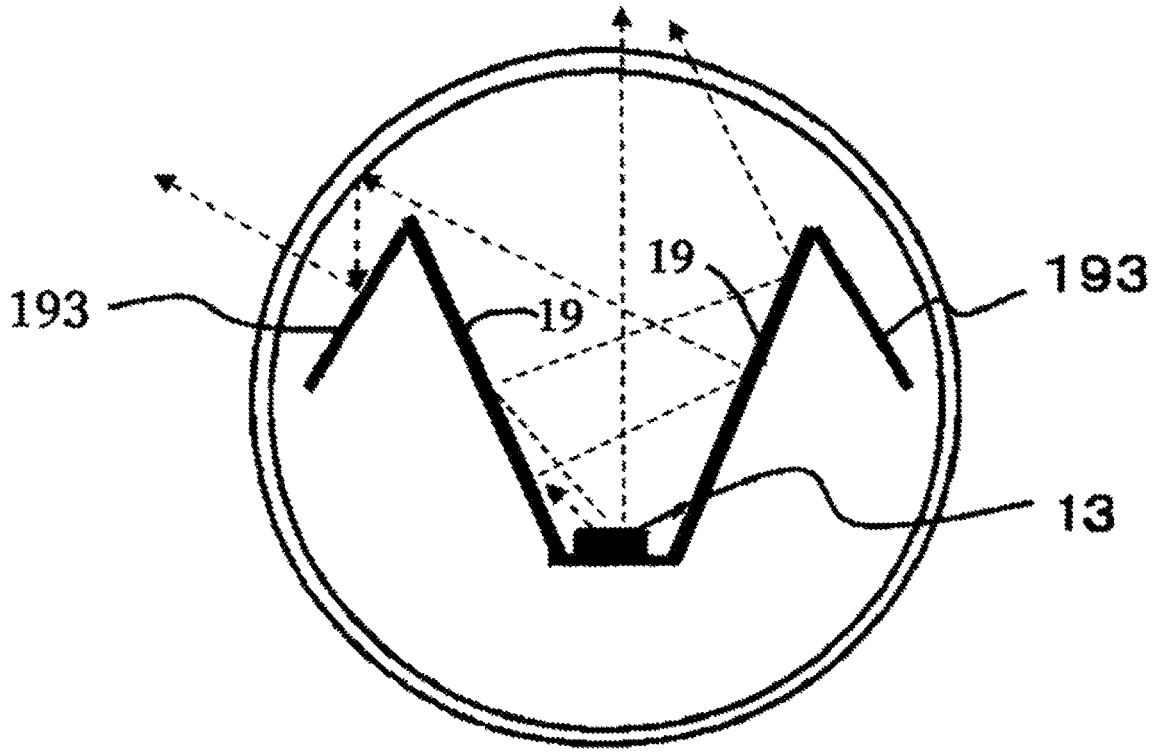
FIG. 4 is a schematic view illustrating an optical path of light emitted from a light source of an LED element used in the light emitting diode type lighting device of FIG. 1.

In FIG. 4, the light reflecting member includes a first reflecting member and a second reflecting member. The reflective member preferably comprises a heat sink member such as an AI member. The first reflection member is set at an elevation angle of 2 to 5 degrees, preferably 30 degrees or more, preferably 40 degrees to 85 degrees, preferably 50 degrees to 65 degrees, and more preferably 85 degrees to 120 degrees with respect to the substrate. The second reflection member is disposed in the wide-angle direction outward from the first reflection member along the shape of the total light beam transmission plate.

The light emitted from the LED element travels straight through the internal space of the first reflecting member from directly below the light source of the LED element and is irradiated from the total luminous flux transmission plate to the outside of the tube. The light is reflected by the light collection reflection surface of the first reflection member, and is emitted to the outside of the tube from the total luminous flux transmission plate through the internal space of the first reflection member. The light is reflected by the light collection reflection surface of the first reflection member, and the light that has reached the total luminous flux transmission plate through the internal space of the first reflection member is reflected by the second reflection member and is passed through the light confinement means, and irradiated from the total luminous flux transmission plate to the outside of the tube. The light transmits or transmits the light emitted from the LED element through the first reflection member, and the total luminous flux transmission through the light confinement means in the space formed between the first reflection member and the total luminous flux transmission plate It is irradiated from the plate to the outside of the tube.

The illuminance activation means may be any means for activating the illuminance of the light emitted from the light confinement means in the light confinement means. For example, the activation means (1) provides a member for activating light reflection to the light reflecting member provided in the total luminous flux transmitting plate, and/or (2) in the space between the total luminous flux transmitting plate and the light reflecting member, a light reflecting member provided on the inner surface of the light reflecting member facing the total light beam transmitting plate, or (3) a light reflecting member provided on the inner surface of the recess provided on the light reflecting member facing the total luminous flux transmission plate, and/or (4) a light reflection member provided on the inner surface of the space between the and the light reflection member.

The illuminance activating means is provided with a light reflecting sheet, a light reflecting film, a light diffusing sheet, a light step film, a mirror, and the like on the light reflecting surface facing the total light flux transmitting plate. The inner surface of the recess or void is preferably jagged with a zigzag shape, for example. The light reflecting member is preferably coated with silver, silver, or a coating or plating according to this in order to enhance the reflection efficiency.

Preferably, the light reflecting member has light reflecting properties and light transmitting properties. The light reflecting member comprises (1) a light transmitting means, for example a slit or a nano-sized pore, for introducing light into the light confinement means, and/or (2) the transmitting light, and/or the light transmitting is preferable to use an excellent material.

The light reflecting member may be a mixture of a high reflectance polycarbonate and a high transmittance polycarbonate, or may be formed of high permeability polycarbonate. The light reflection member may be provided with a high reflection member on the surface. The light reflecting member is preferably made of a resin such as polycarbonate or acrylic, a metal material such as aluminum, iron or stainless steel, glass, wood, paper, or Japanese paper.

The reflection member preferably has a total reflectance of 40% or more. The light reflecting member preferably has a light transmittance of 50% or more. The total reflectance and/or the light reflectance of the reflective member is preferably selected appropriately according to the purpose of use, or it is preferable to use a graphene thin film or a highly transparent polycarbonate to enhance the light transmission property.

Figure 5:
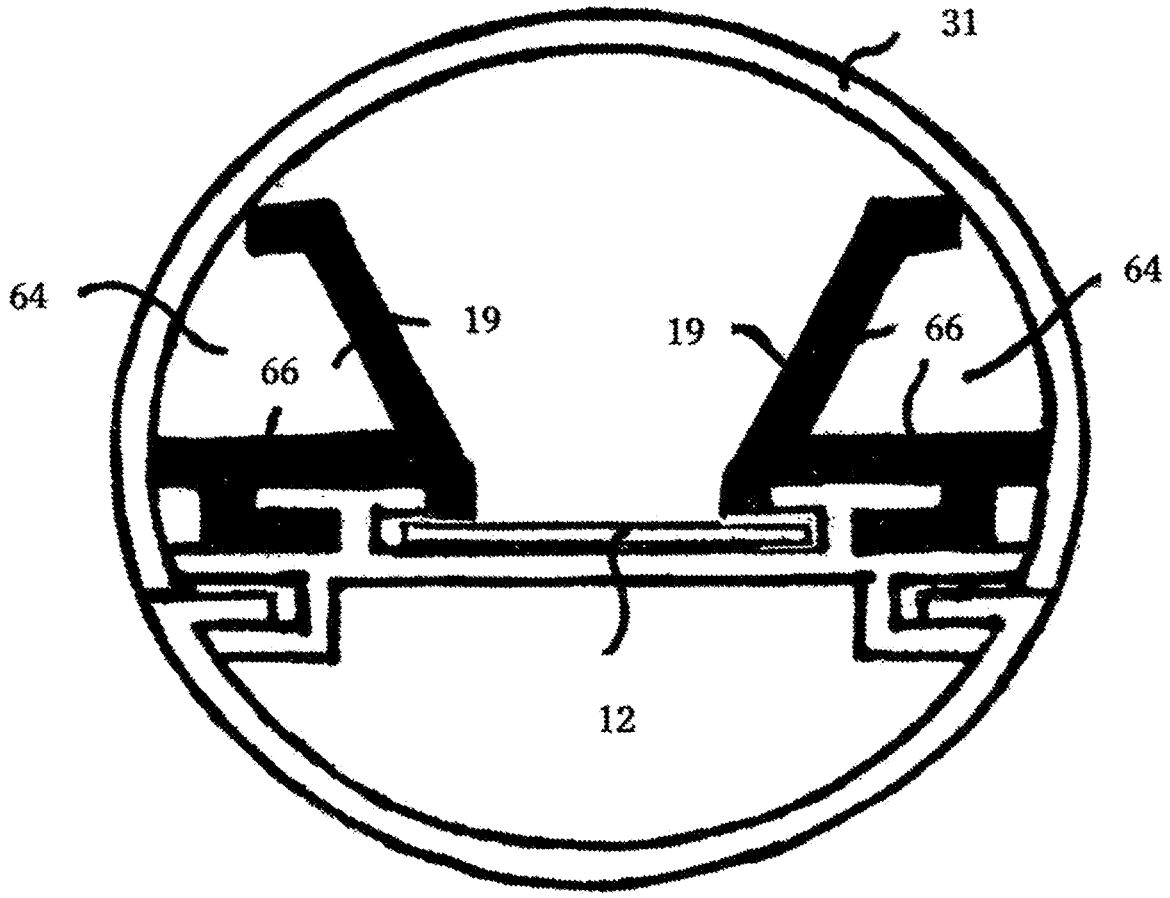
FIG. 5 is a schematic view showing a means for confining the light emitted from the light source of the LED element used in the light emitting diode type lighting device of FIG. 1.

As shown in FIG. 5, when the light confining means is formed in a space provided with the first reflection member and the full light flux transmitting plate, the light confining activation means may be disposed a fourth reflecting member at a position of −30 degrees to +30 degrees with respect to the installation position of LED side facing the full light flux transmitting plate The first reflection member includes a light directing formation surface for irradiating outside of the tube through a total luminous flux transmission plate from LED illumination tube for forming a light directing the light emitted from the LED element. The second reflection member includes a light reflection surface provided with light reflection characteristics provided opposite to the total luminous flux transmission plate and disposed in the illumination tube. The second reflection member is preferably disposed in the wide-angle direction outward from the end of the first reflection member along the shape of the total light beam transmission plate. The second reflection member is provided along the curved surface of the total luminous flux transmission plate. The LED illumination tube does not have to be provided with the total luminous flux transmission plate disposed in the light irradiation direction. The reflecting member may be provided with a third light reflecting member between the first reflecting member and the second reflecting member. The light reflecting member can be provided with a shape closer to the shape of the curved surface of the total luminous flux transmission plate by providing the third light reflecting member.

Figure 6:
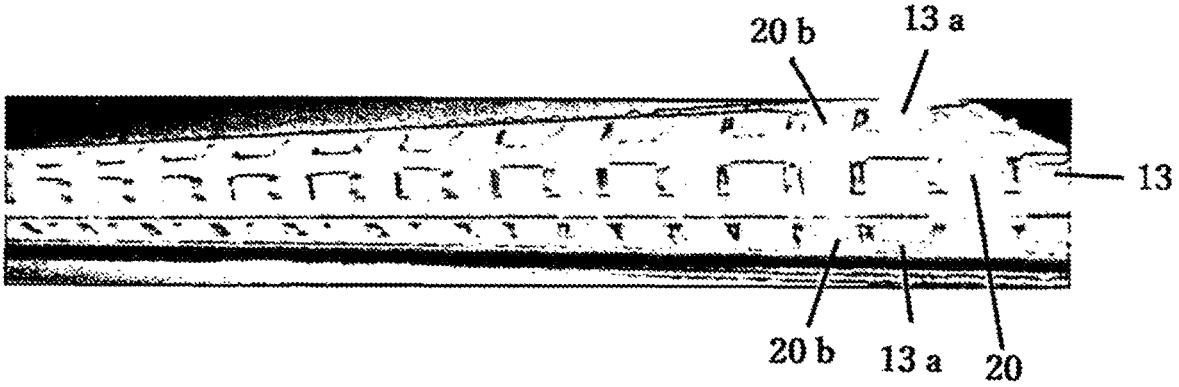
FIG. 6 shows a photograph in which the pseudo LED element of the LED element mounted on the substrate is seen in the pseudo LED formation surface of the first reflection member.
Figure 7A:
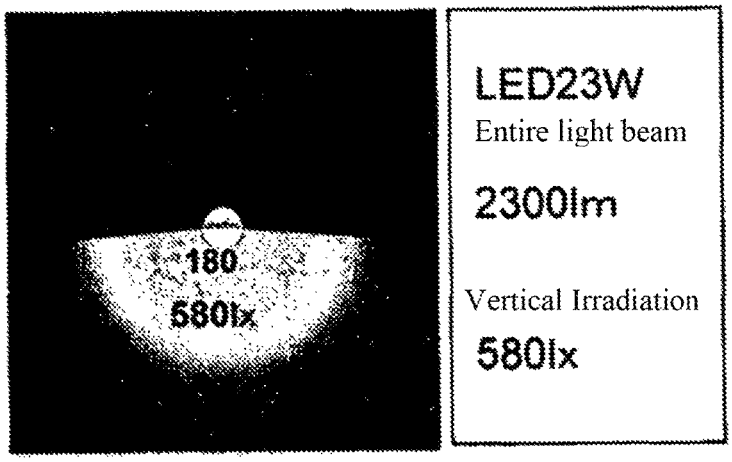
FIG. 7(*a*) is schematic which shows irradiation of the light from a LED element.
Figure 7C:
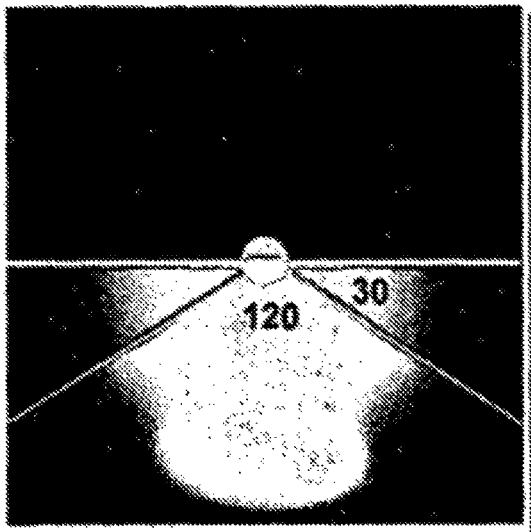

The first light reflecting member is the light directivity forming surface for irradiating the outside of the tube from the LED illumination tube, and a pseudo LED element forming face for projecting a pseudo LED element of the LED element mounted the substrate on the light collecting reflection surface on the side facing the LED element. The pseudo LED element formation surface preferably shows the pseudo LED elements of the LED device mounted on the substrate on the first light reflection member, preferably on the pseudo LED element formation surface in a plurality of for example, 2, 3, 5 rows. The pseudo LED element forming surface may form a light directivity forming surface. In FIG. 6, When the light emitted from the LED element disposed on the substrate is viewed from the direction in which the light is emitted, the pseudo LED element of the LED element mounted on the substrate is shown in the LED formation surface.

The elevation angle of the first light reflecting plate is set to 40 degrees to 85 degrees. The distance between the edge of the arrangement of the LED elements and the first reflection plate is set to 0.1 to 5.0 mm. The height of the first light reflecting plate is set to 5 times or more of the width of the LED element, preferably 10 to 20 mm. As a result, the light reflection plate can obtain a wide irradiation angle, and can eliminate the loss of light quantity, and can improve the illuminance and the PPFD. The illuminance emitted by the LED light source is preferably 1.5 to 2.0 times. The elevation angle of the first reflection member with respect to the substrate, the distance between the end of the LED element and the reflection plate, and the height of the reflection plate are varied according to the drive voltage and light flux of the LED and the diameter of the LED irradiation tube.

The tube of the light emitting diode type lighting device can have various shapes without being limited to a substantially semi-cylindrical shape. The tube is made of glass or synthetic resin or the like. The tube may be a member integrally formed of a material having a predetermined elasticity such as polycarbonate resin so as to be a long semi-cylinder. The whole or a part of the tube may be formed of a translucent, transparent, translucent or colored transparent material.

The LED element is a surface-mounted white LED that emits white light when a predetermined voltage is applied. It is preferable that the LED elements be arranged at regular intervals so as to be aligned in the longitudinal direction of the substrate at a central position in the width direction on the front surface side of the substrate. The LED elements may be arranged in multiple rows along the longitudinal direction of the substrate.

Hereinafter, an embodiment of the present invention will be specifically described with reference to the attached drawings. The present invention is not limited to the embodiments. A person skilled in the art may make various changes, combinations, or substitutions of the components of the embodiment within the technical scope of the present invention or the equivalent thereof.

Figure 1:
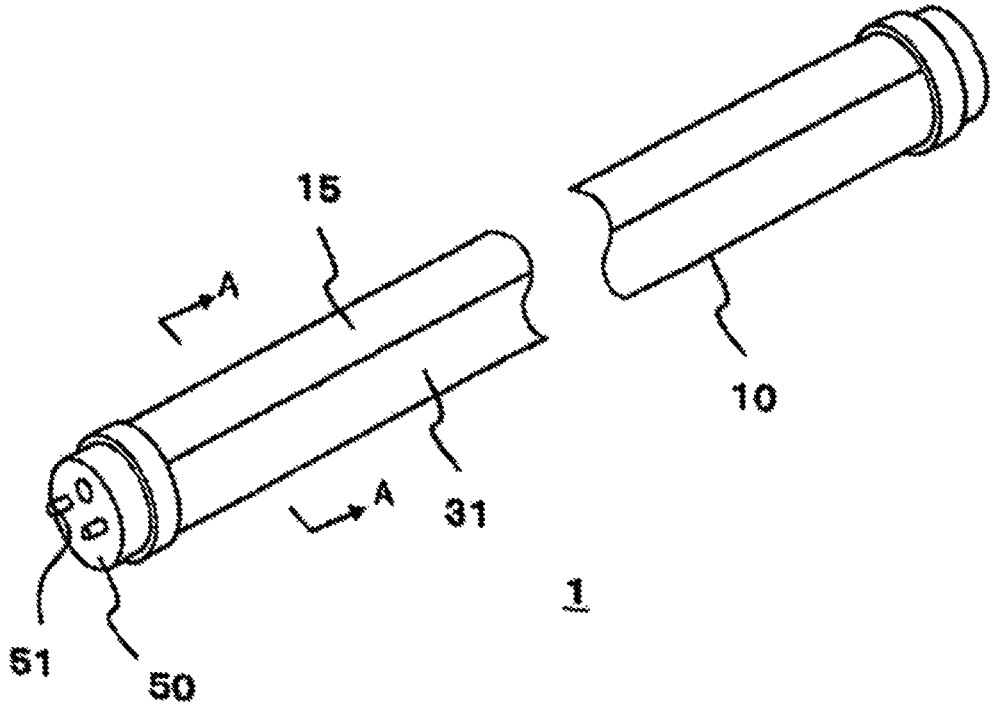
FIG. 1 is a perspective view of a straight tube light emitting diode type lighting device according to the present invention.
Figure 2:
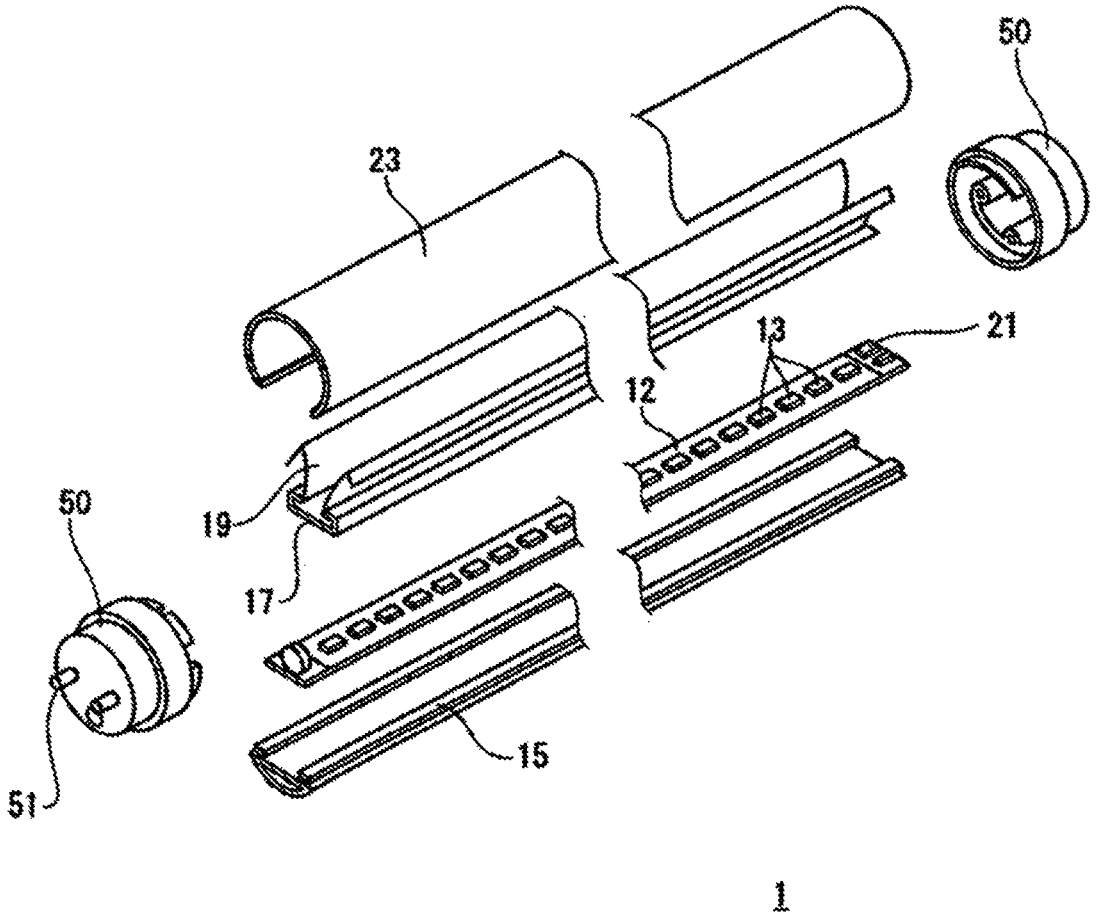
FIG. 2 is an exploded perspective view of the straight tube light emitting diode type lighting device of FIG. 1.

FIG. 1 is a schematic view showing a light emitting diode type lighting device according to the present invention. FIG. 2 is an exploded perspective view of the straight tube light emitting diode lighting device shown in FIG. FIG. 3 is a cross-sectional view of the straight tube light emitting diode lighting device shown in FIG. 1, taken along line AA.

Figure 3:
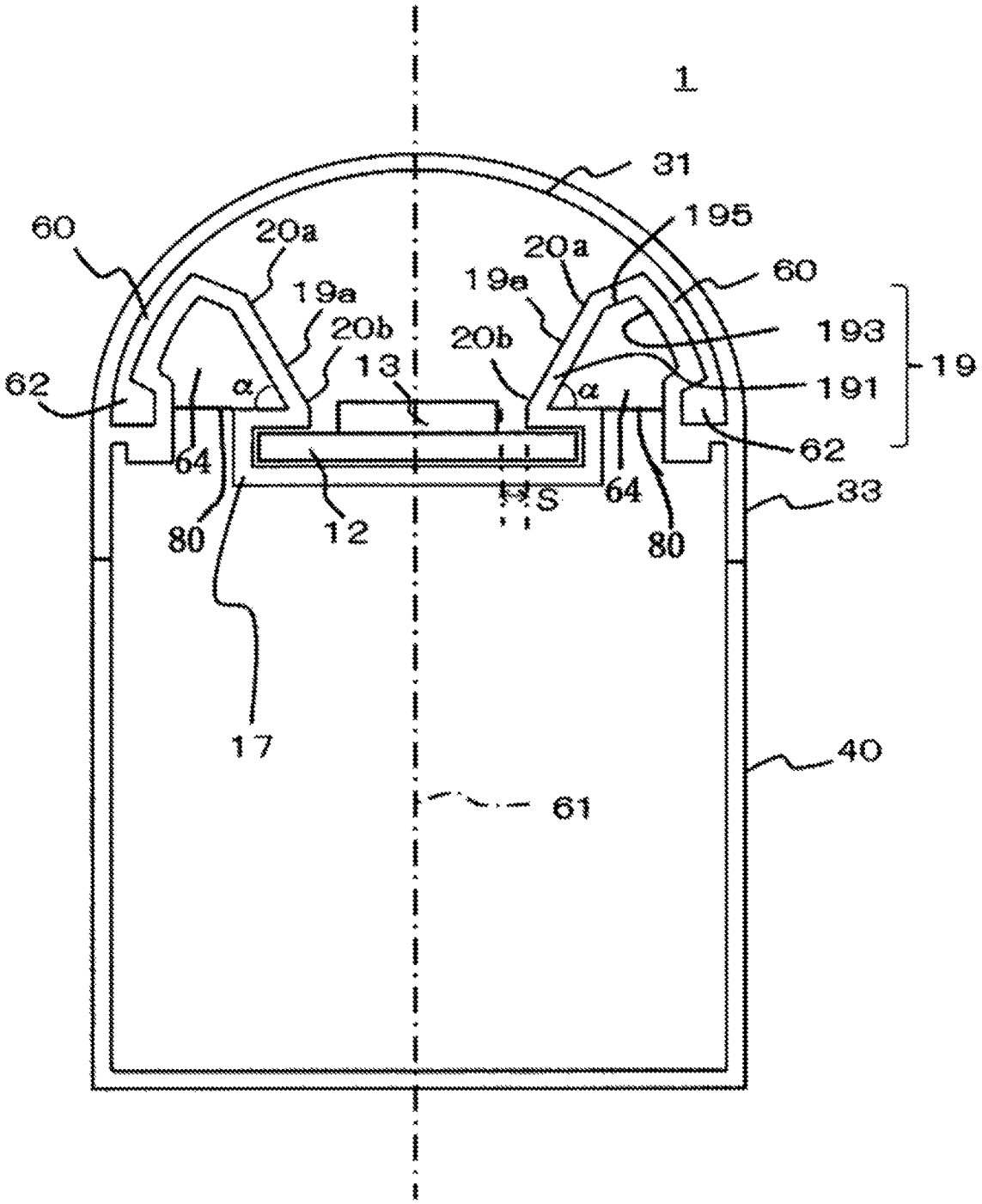
FIG. 3 is a cross-sectional view of the straight tube light emitting diode type illumination device according to the embodiment of FIG. 1.

The light emitting diode type illumination device 1 shown in FIG. 3 includes a cylindrical tube 10 provided with a translucent cover 31 and a tube member 15 provided with a full luminous flux transmission plate, and a light source of an LED element disposed inside the cylindrical tube 10, 13, the substrate 12 on which the LED element 13 is mounted, the substrate support member 17, the light reflection member 19, the LED controller 22, and the end cap 50. The light reflecting member 19 includes a first light reflecting member 191, a second light reflecting member 193, and a third light reflecting member 195. The tube member, the substrate support member 17, the first light reflecting member 191, the second light reflecting member 193, and the third light reflecting member 195 may be made of a heat sink material such as aluminum, copper, iron, or plastic preferable. The light reflecting member is made of a mixture of a high reflectance polycarbonate material and a high transmittance polycarbonate material.

The light emitted from the LED element is irradiated to the outside of the tube through the total luminous flux transmitting plate 31 through the light reflecting member 19. The light emitted from the LED element is irradiated to the outside of the tube through the total luminous flux transmitting plate through the light condensing surface of the condensing reflecting surface 19*a* of the first light reflecting member 191. At this time, the emitted light is (1) confined/captured in the total luminous flux transmission plate 31 disposed corresponding to the light reflection surface 193*a* of the second light reflection member 193, and/or (2) is confined in the light confinement path 60 formed between the second light reflecting member 193 and the total luminous flux transmission plate 31, (3) is confined in the recess 62 of the light reflecting member provided in the light confinement path 60, (4) is confined in the space 64 formed by the total luminous flux transmission plate 3 land the light reflecting member 19. The light thus confined is activated by the illumination activating means. The activated light is irradiated from the total luminous flux transmission plate 31 to the outside of the tube.

The illuminance activation means activates the irradiation light confined in the light confinement means. The illuminance activation means includes at least one of a light reflecting sheet, a light reflecting film, a light diffusing sheet, a light diffusing film, a light reflecting film, a mirror, and an unevenness or jagged inner surface of a recess or cavity on the light reflecting surface facing the total luminous flux transmitting plate Configured It is preferable to apply silver coating, silver plating or the like to the light reflecting member in order to enhance the reflection efficiency.

In the embodiment, it is preferable that the substrate support member 17 and the first light reflection member 191 be integrally formed. It is preferable that the first light reflecting member 191, the second light reflecting member 193, and the third light reflecting member 195 be integrally formed. It is preferable that the substrate supporting member 17, the first reflecting member 191, the second light reflecting member 193, and the third light reflecting member 195 be integrally molded. If plastic is used for these members 17, 191, 193, 195, these members can be easily integrally molded. Alternatively, these members may be made separately, and then these members may be bonded with an adhesive, screws or the like.

The support member 17 of the substrate and the light reflection member 19 are integrally formed. It is preferable that the light confined in the light confinement space 62 of the light reflection part is irradiated from the total luminous flux transmission plate 31 to the outside of the tube. The light reflecting member 19 and the support member 17 may be made separately and then fixed with screws or an adhesive. The light reflecting member 19 may be detachably attached to the locking portion. Preferably, the first light reflecting member 19 is integrally provided on the substrate 17.

By using the heat sink members, the pipe member 15, the support member 17 of the substrate, and the light reflecting members 191, 193, and 195 can obtain a high heat dissipation effect. For example, when the heat sink member is made of aluminum, the temperature of the portion touched by the human body can be made safe at 40° C. or less. The heat sink material is preferably aluminum or copper having excellent thermal conductivity.

As shown in FIG. 3, the substrate 12 is housed and supported in a longitudinally shaped internal space (closed space) of the support member 17 of the substrate. The LED element 13 is disposed in a stripe-like opening formed on the side of the light-transmissive cover 31 of the support member 17 of the substrate, with the light emitting surface facing the full luminous flux transmission plate.

As shown in FIG. 3, the LED element 13 is disposed on the center line 61 of the all-beam transmitting plate 31, which is a cross section of the closed space of the lighting device 1. The total luminous flux transmission plate 31 preferably has a total luminous transmittance of 95% or more. This transmission version used ML series which is a high diffusion type manufactured by Teijin Limited. Here, the total luminous transmittance (%) is represented by the total luminous flux when the test piece is placed and the total luminous flux when the test piece is not placed×100.

The LED elements mounted on the substrate 12 are arranged in one row or a plurality of rows at predetermined intervals in the longitudinal direction of the substrate. As shown in FIG. 2, a plurality of LED elements are mounted on the substrate 12 at equal intervals along the longitudinal direction. The substrate 12 comprises an LED controller 21 at its end. It is preferable that the first light reflecting member is provided with the light collecting reflection surface 19 *a* on the LED element side. It is preferable that the light collecting reflection surface 19*a* includes a light directing formation surface 20*a* and a formation surface 20*b* of a pseudo LED element for projecting a pseudo LED element of the LED element mounted on the light reflection surface on the side facing the LED element.

It is preferable that the first light reflecting member 191 be provided with the condensing reflecting surface 19*a* on the LED element side. It is preferable that the condensing and reflecting surface 19*a* includes a light directing forming surface 20*a* and a pseudo LED element forming surface 20*b* that reflects the pseudo LED element of the LED element mounted on the light reflecting surface on the side facing the LED element.

The spacing length (S) between the end of the LED element and the light condensing reflection surface of the first reflection member 19 is set to 0.1 mm to 5.0 mm, preferably 0.5 mm to 2.0 mm, and the first light The elevation angle α of the reflecting member 19 is set to 45 to 85 degrees, preferably 50 to 65 degrees, and the total reflectance of the reflecting member is set to 80% or more. The interval may be zero as long as an electrical insulating material is provided on a part of the light collecting reflection surface.

The spacing length (S) between the end of the LED element and the light condensing reflection surface of the first reflection member 19 is set to 0.1 mm to 5.0 mm, preferably 0.5 mm to 2.0 mm, and the first light The elevation angle α of the reflecting member 19 is set to 45 to 85 degrees, preferably 50 to 65 degrees, and the total reflectance of the reflecting member is set to 80% or more. The interval may be zero as long as an electrical insulating material is provided on a part of the light collecting reflection surface.

The pseudo LED element of the LED element mounted on the substrate is projected onto the condensing reflecting surface 19*b* of the first reflecting member 19. When viewed from the lower side of the LED element mounted on the substrate from the irradiation direction of the LED element, the pseudo LED is projected on the condensing reflection surface 19*a* of the first reflection member 19 (FIG. 6).

The first light reflecting member 191 has a light reflecting surface 19 *a* in the extending portion 23 extending toward the all-beam transmissive plate 31 in the direction in which the light emitted from the LED element mounted on the substrate travels. The extending portions 23 are disposed symmetrically or asymmetrically on both sides of the LED element with respect to the center line of the LED element in the traveling direction of light emitted from the LED element mounted on the substrate. It is preferable that the extension part 23 be disposed in a posture to direct the light from the LED element to the translucent cover 31.

The first light reflecting member 19 extends along the curved shape of the first light reflecting member 191 extending at a predetermined elevation angle; A third light reflecting member 195 is provided which bends and is provided with a second light reflecting member 193 and a first light reflecting member 191 and the second light reflecting member 193. The light reflecting member 19 may be formed in a multistage configuration in which light reflecting members are connected without being limited to the configuration of the first light reflecting member 191, the second light reflecting member 193, or the third light reflecting member 195.

It is preferable that the second light reflecting member 193 and the third light reflecting member 195 be provided with light reflecting surfaces 193*a* and 195*a* having light reflecting properties on the side facing the all-beam transmitting plate 31, respectively.

In order to direct the light emission illuminance of the LED element to be equal to or higher than that of a conventional fluorescent tube, it is preferable to set the total reflectance of the light collection reflection surface of the first reflection member to 80% or more. The condensing and reflecting surface is preferably plated with silver, silver, chrome or the like. The illuminance is determined based on the light brightness theorem that "the brightness is inversely proportional to the square of the distance from the light source to the illumination surface".

The light emitted from the LED element is emitted to the outside of the tube through the total light flux transmitting plate via the first light reflecting member 191. In this case, the elevation angle of the first light reflecting member 191 with respect to the substrate is set to 45 degrees to 85 degrees, preferably 50 degrees to 65 degrees. The distance (s) between the end of the LED element and the first light reflecting member is set to 0.5 to 5.0 mm, and the height of the reflecting plate is at least five times the width of the LED element, preferably 10 to It is set to 20 mm.

The irradiation angle of the light emitted from the LED element to the outside of the tube through the total luminous flux transmitting plate is 120 degrees to 180 degrees, and the total luminous flux is 2,000 to 3,000 lm.

The lightening apparatus of the present invention can set the irradiation distribution to a wide angle (140 degrees or more). Also, the illumination and orientation according to the invention is possible with 50% power consumption of fluorescent lamps. Power consumption can be reduced by about 12 to 13% compared to fluorescent lamps. Also, the illuminance and PPFD are 2 to 3 times. In addition, it does not emit high heat like fluorescent light, which contributes to safety and security. The weight of the lighting device is less than 500 g.

It is preferable that the drive device of the AC power supply is disposed below the substrate on which the LED element is mounted in the LED lighting tube or on the back side of the light collection reflection surface of the reflection member.

The forward voltage for driving the LED element is at least 1.5V to 4.5V. The drive voltage is preferably driven by a single power supply. When this voltage is applied to the LED element, when the LED element mounted on the substrate is viewed from the direction of light emitted from the LED element mounted on the substrate, the pseudo LED is projected on the formation surface of the pseudo LED.

The light emitting diode type lighting device according to the present invention is preferably a straight tube light emitting diode type lighting device. The lighting device may be used as a light source of an electronic device, for example a backlight of a liquid crystal device.

The invention claimed is:

1. A light emitting diode illumination device comprising:

an LED illumination tube provided with a total luminous flux transmission plate facing in a light irradiation direction;

an LED element provided on an installation opposite facing the total transmission plate in the LED illumination tube; and a light reflecting member provided with a light for collecting and reflecting surface the light emitted from the LED element, wherein the light reflecting member is disposed to extend in the light irradiation direction symmetrically or asymmetrically with respect to a center line of the LED element, and the light reflecting member is configured to form light confinement means for confining the light from the LED element and has illuminance activation means for activating the light confined in the light confinement means, and the light confinement means comprises a recess provided in the light reflecting member facing the total light beam transmitting plate, and the illuminance activation means is provided in the recess.

2. The light emitting diode illumination device according to claim 1, wherein the light reflecting member comprises a light collecting reflection surface configured to direct the light emitted from the LED element to an outside of the LED illumination tube through the total luminous flux transmitting plate, and a pseudo LED element formation surface configured to reflect the LED element as a pseudo LED element.

3. The light emitting diode illumination device according to claim 1, wherein the light reflecting member comprises a first reflecting member extending in the light irradiation direction symmetrically or asymmetrically with respect to the installation surface of the LED element, and a second reflecting member connected to the first reflecting member and extending along a shape of the light beam transmission plate.

4. The light emitting diode illumination device according to claim 1, wherein the illuminance activation means further comprises a material for activating the reflected light from the light reflecting member provided inside the LED illumination tube, the material comprising a light reflecting material provided on an inner surface of the reflecting member facing the total light beam transmitting plate, and/or a light reflecting material provided on the inner surface of the recess provided in the reflecting member facing the total light beam transmitting plate, and/or a light reflecting material provided on an inner surface of a space between the total luminous flux transmitting plate and the light reflecting member.

5. The light emitting diode illumination device according to claim 1, wherein the illuminance activation means comprises at least one of a light reflecting sheet, a light reflecting film, a light diffusing film, a light diffusing sheet, a mirror, and gold or silver plating on the light reflecting surface facing the total light flux transmitting plate.

6. The light emitting diode illumination device according to claim 1, wherein the light reflecting member comprises a first reflecting member extending in the light irradiation direction symmetrically or asymmetrically with respect to the installation surface of the LED element, a second reflecting member connected to the first reflecting member and extending along a shape of the light beam transmission plate, and a third reflecting member positioned between the first reflecting member and the second reflecting member.

* * * * *